US005129837A

United States Patent [19]

Williams

[11] Patent Number: 5,129,837

[45] Date of Patent: Jul. 14, 1992

[54] CONNECTOR WITH SELF-LOCKING APPARATUS

[76] Inventor: Robert A. Williams, 2721 White Settlement Rd., Fort Worth, Tex. 76107

[21] Appl. No.: 815,076

[22] Filed: Dec. 27, 1991

[51] Int. Cl.[5] ..... H01R 4/50

[52] U.S. Cl. ..... 439/348; 439/349; 439/342

[58] Field of Search ..... 439/348, 345, 349, 374, 439/376, 310, 342; 279/75, 905

[56] References Cited

U.S. PATENT DOCUMENTS

| | | | |
|---|---|---|---|
| 2,521,701 | 9/1950 | Earle et al. | 439/348 X |
| 2,933,712 | 4/1960 | Klopfenstein | 439/348 |
| 3,085,219 | 4/1963 | Bass, Jr. | 439/348 X |
| 3,422,390 | 1/1969 | Tucker | 439/348 |
| 3,888,559 | 6/1975 | Geib | 439/348 X |
| 4,582,347 | 4/1986 | Wilcox et al. | 439/348 X |
| 4,605,271 | 8/1986 | Burns | 439/348 X |

FOREIGN PATENT DOCUMENTS

| | | | |
|---|---|---|---|
| 082060 | 11/1963 | France | 439/348 |
| 7600515 | 8/1977 | France | 439/348 |
| 1444745 | 8/1976 | United Kingdom | 439/348 |

*Primary Examiner*—Steven C. Bishop
*Assistant Examiner*—Julie R. Daulton
*Attorney, Agent, or Firm*—Arthur F. Zobal

[57] ABSTRACT

The connector has an annular side wall with ball receiving apertures formed therethrough and a rearward flared wall. An insert having a rearward flared wall and carrying electrical contacts is located in the annular side wall. An annular receptacle having ball supporting apertures formed therethrough is located between the insert and the annular side wall for movement to forward and rearward positions where the receptacle apertures are out of and in alignment respectively with the annular side wall apertures. An outer annular spring is located around the flared wall of the insert for urging the receptacle to its forward position. An outer annular member having forward and rearward grooves separated by an inward extending wall is located around the annular side wall for movement to forward and rearward positions. A second annular spring is located around the flared wall of the annular side wall and in the rearward groove of the outer annular member for urging it to its forward position. Balls are located in the apertures of the annular side wall. When the receptacle is in its forward position, the balls cannot enter the receptacle apertures and when the receptacle is moved to its rearward position, the balls will enter and partially extend through the receptacle apertures and will be held therein by the inward extending wall of the outer annular member when it is in its forward position. The balls can be released from the receptacle apertures by moving the outer annular member to its rearward position.

3 Claims, 2 Drawing Sheets

CONNECTOR WITH SELF-LOCKING APPARATUS

FIELD OF THE INVENTION

The invention relates to electrical connectors.

DESCRIPTION OF THE PRIOR ART

Electrical connectors have been used in which a locking connector is removably locked to a grooved connector with the use of balls in the locking connecter with fit into a groove of the grooved connector. The prior art locking connector uses a plurality of compression springs and a wave type spring for causing the balls to fit into the groove of the grooved connector. The prior art locking connector has disadvantages in that the assembly of the case is a snap-on device which causes metal to be shaved off, remaining in the device which affects the spring loading. This causes the balls to jam.

SUMMARY OF THE INVENTION

It is an object of the invention to provide an improved connector of the type that uses balls for removably locking the connector into the groove of a grooved connecter.

The connector of the invention has an annular side wall with ball receiving apertures formed therethrough and a rearward flared wall rearward of the apertures. An insert having a rearward flared wall and carrying electrical contacts is located in the annular side wall. An annular receptacle having ball supporting apertures formed therethrough is located between the insert and the annular side wall for movement to forward and rearward positions where the receptacle apertures are out of and in alignment respectively with the annular side wall apertures. An annular spring is located around the flared wall of the insert for urging the receptacle to its forward position. An annular outer member having forward and rearward annular grooves formed in its inner wall separated by an inward extending wall is located around the annular side wall for movement to forward and rearward positions. A second annular spring is located around the flared wall of the annular side wall and in the rearward groove of the outer member for urging it to its forward position. Balls are located in the apertures of the annular side wall. When the receptacle is in its forward positions, the balls cannot extend into the receptacle apertures and prevent the annular outer member from moving to its forward position. When the receptacle is moved to its rearward position, the balls will extend into the receptacle apertures and held therein by the inward extending wall of the outer member when it moves to its forward position. The balls can be released from the receptacle apertures by moving the outer member to its rearward position.

In using the connector of the invention, the grooved connector is used to push the receptacle to its rearward position causing the annular side wall and receptacle apertures to become aligned allowing the balls to enter the receptacle apertures and to extend into the groove of the grooved connector for removably locking the two connectors together. In order to disconnect the two connectors, the outer member is moved to its rearward position to move the inward extending wall away from the balls to locate the forward groove of the outer member next to the balls allowing the two connectors to be released from each other.

The connector is much simpler in construction than the prior art connector and the springs are durable springs and provide satisfactory spring loading with minimal spring fatigue.

DESCRIPTION OF THE PREFERRED EMBODIMENT

Figure 1:
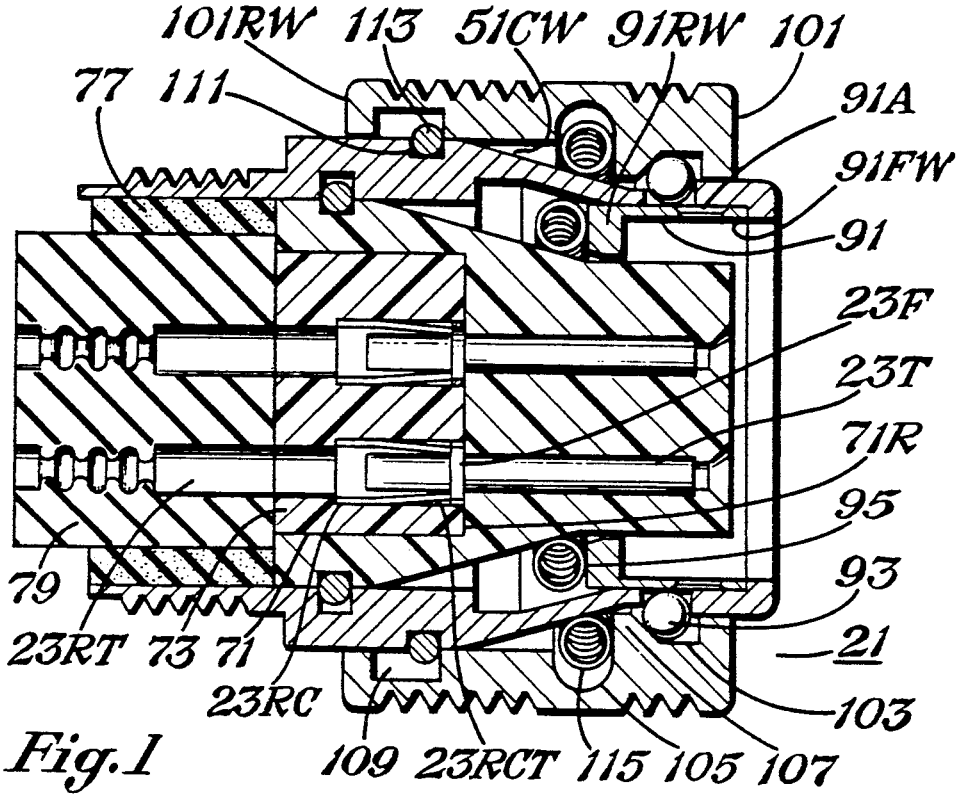
FIG. 1 is a cross-sectional side view of the connector of the invention with its receptacle in its forward position and its grip member in its rear position.

Referring now to the drawings, the connector of the invention is identified by reference numeral 21. It has a plurality of female electrical contacts 23 connected to leads 25 for connection to male contacts 27 carried by a grooved connector 29. The connector 29 comprises an annular metal wall 31 with an electrical insulating insert 33 which carries the contacts 27 which are connected to leads 35. The front annular wall 37 of the connector 29 has a forward central opening 39 and an annular groove 41 formed around its outside. The male and female contacts can be reversed.

The connector 21 comprises an annular metal side wall 51 having a front end 53 and a rear end 55 with a central opening 57 extending between the ends 53 and 55.

A forward insert 59 of electrical insulating material is located in the opening 57 and is secured therein with a gapped spring metal ring 61 located in annular grooves 63 and 65 formed in the outer and inner walls of the insert 59 and the side wall 51 respectively. The front insert 59 has a rear opening 71 in which is located a rear insert 73 of electrical insulating material. An annular silicone rubber member 77 is located in the rear portion of the opening 57 in which is located an electrical insulating seal member 79. Inserts 59, 73 and member 79 have a plurality of aligned openings 59C, 73C, 79C for receiving the electrical contacts 23. Each contact 23 comprises a front metal tubular member 23T having an annular flange 23F, a tubular metal retainer clip 23RC and a rear metal tubular member 23RT in which a lead 25 is inserted and crimped. The retainer clip 23RC is located in the enlarged part 73CL of the aperture 73C and has flexible wall tabs 23RCT extending inward. The contact 23C is inserted through the aperture 73C of rear insert 73, through the tubular retainer clip 23RC and into the aperture 59C of insert 59 with the front side of the flange 23F engaging the rear wall 71R of the opening 71 of the insert 59. The tabs 23RCT engage the rear wall of the flange 23F and hold the contact member 23 in place and establishes electrical contact therewith. The rear tubular member 23RT electrically contacts the retainer claim 23RC.

The front insert 59 has a front cylindrical shaped outer wall 59FC and a conical shaped outer wall 59CW which flares outward in the rearward direction. Walls 59FC and 59CW are spaced inward from the front portion of the inside wall of member 51.

The front end 53 of wall 51 has an inward extending annular lip 81.

An annular metal receptacle member 91 is located in the space between walls 59FC and 59CW of insert 59 and the front portion of the inside wall of member 51 for movement to a forward position and a rearward position. The receptacle 91 has a forward wall 91FW of relatively large inside diameter and a rear wall 91RW of smaller inside diameter. The forward wall 91FW has a plurality of angularly spaced apertures 91A formed therethrough for receiving metal balls 93. The diameters of the apertures 91A allow the balls 93 to extend partially through the wall 91FW but prevent the balls 93 from passing therethrough.

An annular coiled spring 95 is located around the conical wall 59CW of the insert 59 and engages the back side of the wall 91RW of the receptacle and urges it to its forward position where the front end of the wall 91FW of the receptacle 91 engages the back side of the lip 81 which limits the forward position of the receptacle 91. In the rear position of the receptacle 91, the front end of the wall 91FW of the receptacle 91 is spaced rearwardly of the back side of the lip 81 as shown in FIG. 2.

The front end 53 of the side wall 51 also has a plurality of angularly spaced apart apertures 51A for receiving the balls 93. The diameters of the apertures 51A are large enough to allow the balls 93 to pass therethrough but the balls 93 are prevented from passing through the apertures 51A by the receptacle 91. In the forward position of the receptacle 91, the apertures 91A and 51A are out of alignment and the balls 93 cannot enter the apertures 91A. In the rearward position of the receptacle 91 the apertures 91A and 51A are in alignment and the balls 93 can enter the apertures 91A and extend partially therethrough and into the groove 41 of the grooved connector 29. Although not shown, a tongue (key) and groove (keyway) arrangement is provided between the receptacle 91 and the insert 59 to prevent the receptacle 91 from rotating relative to the insert 59. The key extends radially inward from rear wall 91RW and slidably fits into a longitudinally extending keyway or groove formed in the outside front wall portion of insert 59. In addition, a key extends radially inward from the inside of the body 51 into a longitudinally extending groove formed in the rear wall portion of insert 59 to prevent the body 51 from rotating relative to the insert 59. These keys and grooves prevent the receptacle 91 from rotating relative to the body 51 to insure that the apertures 91A and 51A will be in alignment when the receptacle 91 is moved to its rearward positions. Receptacle 91 is moved rearward only by inserting connector 29 into connector 21 which pushes the receptacle 91 rearward.

Rearward of the apertures 51A, the side wall 51 has a conical shaped outer wall 51CW which flares outward in the rearward direction.

Figure 2:
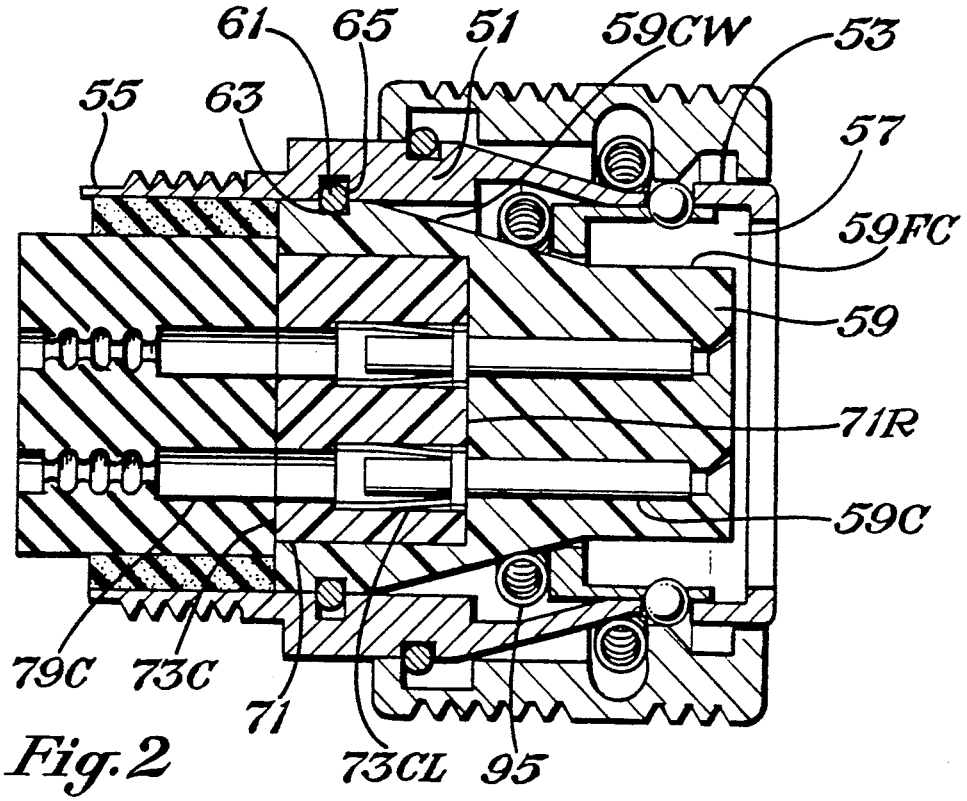
FIG. 2 is a cross-sectional side view of the connector of the invention with its receptacle in its rear position and its grip member in its forward position.
Figure 5:
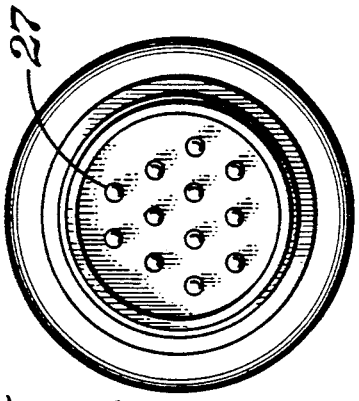
FIG. 5 is an end view of the grooved connector of FIGS. 3 and 4.

Located around the side wall 51 is an annular shaped metal grip member 101 which can be moved axially to a forward position as shown in FIG. 2 and to a rearward position as shown in FIG. 1. The inside wall of the member 101 has front annular grooves 103 and 105 separated by an inward extending annular wall 107 and a rear annular groove 109. The rear outer wall of the side wall 51 has an annular groove 111 in which is located a gapped spring metal ring 113 which also extends in groove 109 for limiting forward and rearward movement of the grip member 101.

Figure 3:
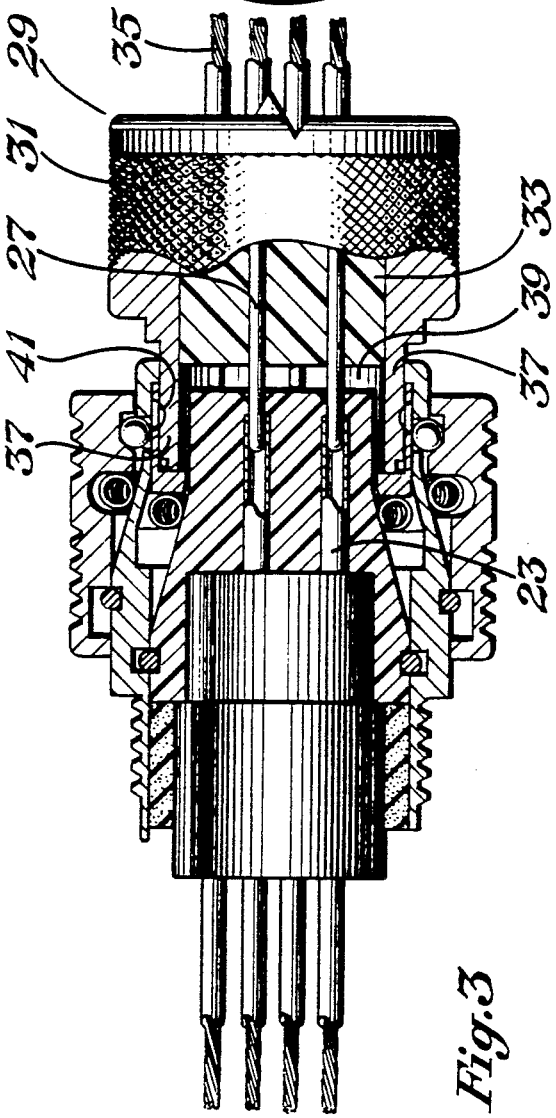
FIG. 3 is a view similar that of FIG. 1 but with a grooved connector shown in a position ready to push the receptacle to its rear position.
Figure 4:
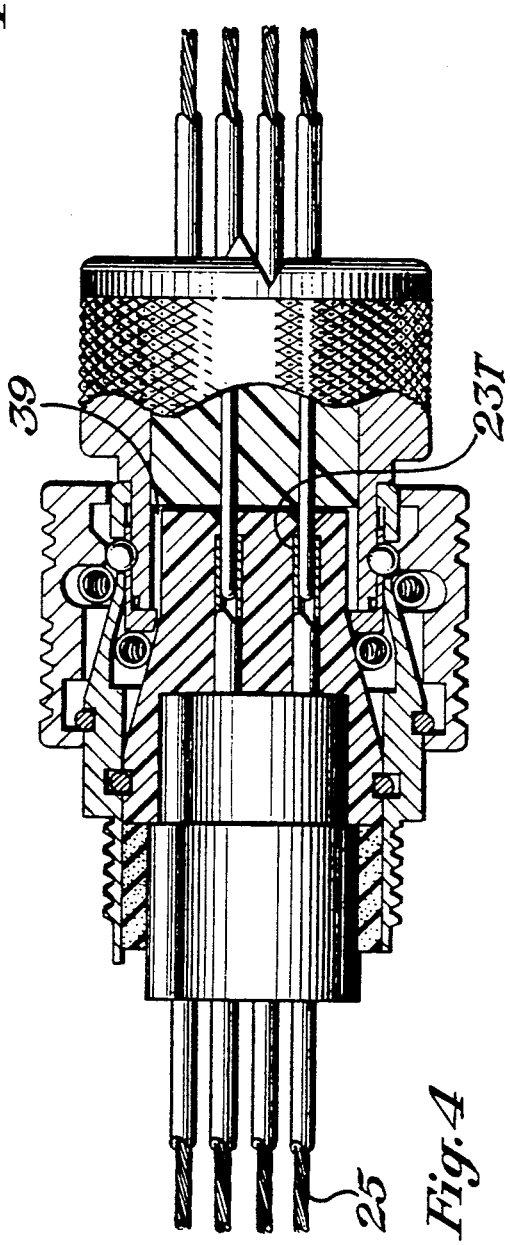
FIG. 4 is a view similar to that of FIG. 2 but with the grooved connector locked to the connector of the invention.

An annular coiled spring 115 is located around the conical shaped wall 51CW and in the groove 105 of the grip member 101 for urging the member 101 to its forward position. In the positions of the components of the connector 21 as shown FIGS. 1 and 3 , however, the balls 93 engage the rear side of the wall forming the groove 103 and prevent the grip member from moving to its forward position. The components of the connector 21 will be in the positions of FIGS. 1 and 3 when it is not connected to the connector 29 and the grip member 101 is released. Although not shown a key extends radially inward from the rear wall 101RW and slidably fits into a longitudinally extending groove formed in the outside wall of the body 51 to prevent the grip member 101 from rotating relative to the body 51.

In connecting the two connectors 21 and 29 together, the front annular wall 37 of the connector 29 is inserted between the outer wall of the insert 59 and the inside wall of the wall member 51 to locate the pin contacts 27 in the tubular contacts 23. The two connectors 21 and 29 then are pushed together such that the end of the wall 37 of the connector 29 engages the outward facing surface of wall 91RW and moves the receptacle to its rearward position against the force of the spring 95 which is expanded outward against the flared wall 51CW. The balls 93 then enter the apertures 91A of the receptacle 91 with portions extending therethrough such that they enter the groove 41 of the connector 29. In this position, the inside surface of the inward extending wall 107 engages the balls 93 and holds them in this position locking the two connectors together.

When it is desired to release the two connectors, the grip member 101 is manually moved to its rear position against the force of the spring 115 which expands against the flared wall 51CW, moving the wall 107 rearward of the balls 93 such that the groove 103 is aligned with the balls 93. The connector 29 then can be pulled out of the connector 21 since the balls 93 can move outward of the groove 41 into the groove 103 whereby the two connectors can be released from each other, allowing the spring 95 to move the receptacle 91 to its forward position.

The two springs 95 an 105 each are helical coiled metal springs having their ends connected together for example as shown by U.S. Pat. No. 4,850,893 which is herein incorporated by reference. The two springs can be expanded radially outward and when released will return to their normal conditions.

What is claimed:

1. An electrical connector with a self-locking apparatus comprising:

an annular side wall with ball receiving apertures formed therethrough and a rearward flared wall rearward of said apertures, an insert having a rearward flared wall and carrying electrical contacts located in said annular side wall, an annular receptacle having ball supporting apertures formed therethrough located between said insert and said annular side wall for movement to forward and rearward positions where the receptacle apertures are out of and in alignment respectively with the annular side wall apertures;

an annular spring located around said flared wall of said insert for urging said receptacle to its forward position, an annular outer member having forward and rearward inner grooves separated by an inward extending wall located around said annular side wall for movement to forward and rearward positions, a second annular spring located around said flared wall of said annular side wall and in said rearward inner groove of said outer member for urging said outer member to its forward position, balls located in said apertures of said annular side wall, such that when said receptacle is in its forward position, said balls cannot extend into said receptacle apertures and when said receptacle is moved to its rearward position, said balls will be located in said receptacle apertures and held therein by said inward extending wall of said outer member when it is in its forward position, said balls being releasable from the receptacle apertures by moving said outer member to its rearward position.

2. An electrical connector member with a self-locking apparatus for connection to another electrical connector member of the type having an annular groove in a forward portion, comprising:

a body comprising an annular side wall having a front end and a rear end with a central opening extending between said front and rear ends, said annular side wall having an inward extending lip at said front end, a plurality of angularly spaced apart ball receiving apertures formed through said annular side wall rearward of said lip, and a flared outer wall portion located rearward of said apertures which flares outwardly in a rearward direction, an insert carrying electrical contacts of a first type, located in and secured to said annular side wall, an insert carrying electrical contacts of a first type, located in and secured to said annular side wall, the front portion of said insert having an outer surface spaced inward from the inside surface of said annular side wall and including a flared portion which flares outwardly in a rearward direction, an annular receptacle member located between said outer surface of said insert and the inside surface of said annular side wall for movement between a forward position and a rearward position, said annular receptacle member having a plurality of angularly spaced apart ball supporting apertures which are in alignment with said ball receiving apertures of said annular side wall when said annular receptacle member is in its rearward position and which are located out of alignment with said ball receiving apertures of said annular side wall when said annular receptacle member is in its forward position, an inner annular coiled spring located around said flared position of said insert and rearward of said annular receptacle member for normally urging said annular receptacle member toward its forward position, an annular outer member located around said annular side wall including said flared outer wall and said apertures of said annular side wall for movement between a forward position and a rearward position, said annular outer member having forward and rearward inner annular grooves separated by an inward extending annular wall, a second annular coiled spring located around said flared outer wall portion of said annular side wall and in said rearward groove of said annular outer member for normally urging said annular outer member toward its forward position, and a plurality of balls located in said apertures of said annular side wall such that when said annular receptacle member is in its forward position, said balls cannot enter said apertures of said annular receptacle member and when said annular receptacle member is moved to its rearward position by said forward portion of said other electrical connector member having electrical contacts of a second type for connection to said electrical contacts of said first type, said balls will enter a portion of the apertures of said annular receptacle, and extend into said annular groove of said forward portion of said other electrical connector and will be held therein by said inward extending wall of said annular outer member to removably lock said two electrical connector members together, said annular outer member being movable to its rearward position to move said inward extending wall away from said balls with said forward groove of said outer member in alignment with said balls whereby said two electrical connector members may be released from each other allowing said inner annular coiled spring to move said receptacle member to its forward position.

3. The self-locking apparatus of claim 2, wherein:

said flared walls of said annular side wall and said receptacle comprise conical shaped walls, said two annular springs each comprise helical coils with two ends connected together to form an annular spring that can expand outward and return inward to a normal position.

* * * * *